US011034919B2

(12) United States Patent
Bhattacharya et al.

(10) Patent No.: US 11,034,919 B2
(45) Date of Patent: Jun. 15, 2021

(54) DISINFECTANT AQUEOUS COMPOSITION AND METHOD FOR TREATING SUBSTRATES

(71) Applicant: Conopco, Inc., Englewood Cliffs, NJ (US)

(72) Inventors: Arpita Bhattacharya, Jabalpur (IN); Sarmistha Biswas, Bangalore (IN); Bijal Dharmvirbhai Shah, Bangalore (IN); Jayashree Anantharam Vadhyar, Bangalore (IN)

(73) Assignee: Conopco, Inc., Englewood Cliffs, NJ (US)

( * ) Notice: Subject to any disclaimer, the term of this patent is extended or adjusted under 35 U.S.C. 154(b) by 480 days.

(21) Appl. No.: 16/078,339

(22) PCT Filed: Feb. 6, 2017

(86) PCT No.: PCT/EP2017/052541
§ 371 (c)(1),
(2) Date: Aug. 21, 2018

(87) PCT Pub. No.: WO2017/144260
PCT Pub. Date: Aug. 31, 2017

(65) Prior Publication Data

US 2021/0062114 A1 Mar. 4, 2021

(30) Foreign Application Priority Data

Feb. 23, 2016 (EP) ..... 16156825

(51) Int. Cl.

| | |
|---|---|
| ***C11D 11/00*** | (2006.01) |
| ***C11D 3/48*** | (2006.01) |
| ***C11D 3/30*** | (2006.01) |
| ***C11D 7/50*** | (2006.01) |

(52) U.S. Cl.
CPC ..... *C11D 3/48* (2013.01); *C11D 3/30* (2013.01); *C11D 7/5022* (2013.01); *C11D 11/0017* (2013.01)

(58) Field of Classification Search
CPC ..... C11D 11/0017
USPC ..... 510/276
See application file for complete search history.

(56) References Cited

U.S. PATENT DOCUMENTS

| | | | | |
|---|---|---|---|---|
| 5,490,948 | A | 2/1996 | Klier et al. | |
| 2008/0287538 | A1* | 11/2008 | Scholz | A23L 3/3517 514/552 |
| 2011/0190187 | A1 | 8/2011 | Hawes, III et al. | |

FOREIGN PATENT DOCUMENTS

| | | |
|---|---|---|
| EP | 0971012 | 1/2000 |
| JP | 2008248104 | 10/2008 |
| WO | WO9905249 | 2/1999 |
| WO | WO0004119 | 1/2000 |
| WO | WO0024856 | 5/2000 |
| WO | WO0078906 | 12/2000 |
| WO | WO0231094 | 4/2002 |
| WO | WO02079362 | 10/2002 |
| WO | WO02079363 | 10/2002 |
| WO | WO02079366 | 10/2002 |
| WO | WO02079367 | 10/2002 |
| WO | WO02079368 | 10/2002 |
| WO | WO02079369 | 10/2002 |
| WO | WO02079370 | 10/2002 |
| WO | WO03044147 | 5/2003 |
| WO | WO03044149 | 5/2003 |
| WO | WO2004035724 | 4/2004 |
| WO | WO2004035726 | 4/2004 |
| WO | WO2007027904 | 3/2007 |
| WO | WO2008157847 | 12/2008 |
| WO | WO200138907 | 12/2010 |
| WO | WO2011036031 | 3/2011 |

OTHER PUBLICATIONS

Clay Minerals; Wikipedia; Aug. 2019; pp. 1-4; https://en.wikipedia.org/wiki/Clay_minerals.
Search Report and Written Opinion in PCTEP2017052541; dated Apr. 24, 2017.

* cited by examiner

*Primary Examiner* — Gregory E Webb
(74) *Attorney, Agent, or Firm* — Greenberg Traurig, LLP

(57) ABSTRACT

The present invention relates to a composition and a method for treating substrates, such as fabrics; in particular a composition that can deliver cleaning and anti-microbial benefits to the fabric thereby delaying laundry. There is a long left need for a composition, which can clean the fabric and deliver anti-microbial benefits without the use of water and detergents. It is therefore an object of the present invention to provide a composition with no surfactants in it which can deliver cleaning and anti-microbial benefits through a single product. It has been found that cleaning and anti-microbial benefits on fabric can be achieved by a solvent mix of a glycol ether, a fatty acid ester and a diol in combination with a bipolar antimicrobial particle in an aqueous solution.

7 Claims, No Drawings

DISINFECTANT AQUEOUS COMPOSITION AND METHOD FOR TREATING SUBSTRATES

FIELD OF THE INVENTION

The present invention relates to a composition and a method for treating substrates, such as fabrics; in particular, a composition which can deliver cleaning and anti-microbial benefits to the fabric thereby delaying laundry.

BACKGROUND OF THE INVENTION

Water is becoming a more and more scarcely available commodity, especially in developing countries, where it is not unusual that people have to walk many kilometres to arrive at a water source. As a result of which, there is an increasing need to save water.

One way of saving water is to reuse the water and another way is to reduce the amount of water being used.

Washing processes, including laundry, dishwashing and other household cleaning processes, require large amounts of water throughout the world. These are daily chores in which the use of water and a detergent cannot be avoided. The use of detergents for laundry consume a large amount of water and currently it is almost impossible to clean fabrics without the use of detergents. Therefore, there is a long left need for a composition which can clean the fabric and deliver anti-microbial benefits without the use of water and detergents.

WO 03/044149 (Unilever) discloses a process of cleaning a substrate, the process comprising the steps of contacting a substrate with a composition comprising at least two liquids mutually presenting a liquid-liquid interface with an interfacial tension of at least 5 mN/m and agitating the substrate and/or composition whilst they are in mutual contact, wherein the composition and/or the substrate are also subjected to ultrasound before and/or during the agitation step. This composition does not comprise a bipolar antimicrobial particle.

WO99/02549 A1 (Colgate Palmolive) discloses a particulate agglomerated carrier is described which is suitable for use in admixture with a laundry detergent composition and which is capable of depositing an effective amount of an antibacterial agent on laundered fabrics and for providing an effective amount of same in the wash solution. The carrier is an agglomerate of a smectite-type clay and an antibacterial agent.

WO11036031 A1 (Unilever) discloses a bipolar antimicrobial particle for use in laundry detergent compositions, fabric conditioners, personal care and cosmetic compositions and a process for making the same. In view of the foregoing, it is an object of the present invention to provide a stable antimicrobial agent immobilised on a carrier particle.

WO0024856 A1 (P&G) discloses fabric care compositions, methods, and articles of manufacture for treating fabrics, comprising an effective amount of fabric care polysaccharides with globular structure.

WO04035724 A1 (Reckitt Benckiser Ltd) discloses a non-cationic antimicrobial agent containing composition which blooms when added to water. The compositions have good cleaning, disinfecting and bloom properties.

WO04035726 A1 (Reckitt Benckiser Ltd) discloses aqueous liquid thickened cleaning and/or disinfecting composition comprising: an alkaline source; at least one surfactant selected from anionic surfactants, non-ionic surfactants, and mixtures thereof; at least one thickener selected from polysaccharides, polycarboxylates, polyacrylamides, clays, and mixtures thereof; a solvent selected from alcohols, glycol ethers, and mixtures thereof; at least one abrasive material It is therefore an object of the present invention to delay laundry.

It is another object of the invention to provide a composition which can deliver cleaning and anti-microbial benefits through a single product.

It is yet another object of the invention to provide a cleaning composition which contains no surfactants.

Surprisingly, it has been found that cleaning and antimicrobial benefits on fabric can be achieved by a solvent mix of a glycol ether, a fatty acid ester and a diol in combination with a bipolar antimicrobial particle in an aqueous solution.

SUMMARY OF THE INVENTION

Accordingly, in a first aspect, the invention provides an aqueous composition as claimed in claim 1.

In a second aspect, the invention provides a method for treating a substrate comprising the steps in sequence of applying the composition according to the invention onto the substrate; and allowing the substrate to dry.

In a third aspect, the invention provides the use of the composition according to the invention for cleaning and antimicrobial benefits.

In the context of the present invention, reference to substrate means fabric or hard surface.

These and other aspects, features and advantages will become apparent to those of ordinary skill in the art from a reading of the following detailed description and the appended claims. For the avoidance of doubt, any feature of one aspect of the present invention may be utilised in any other aspect of the invention. The word "comprising" is intended to mean "including" but not necessarily "consisting of" or "composed of." In other words, the listed steps or options need not be exhaustive. It is noted that the examples given in the description below are intended to clarify the invention and are not intended to limit the invention to those examples per se. Similarly, all percentages are weight/weight percentages unless otherwise indicated. Except in the operating and comparative examples, or where otherwise explicitly indicated, all numbers in this description indicating amounts of material or conditions of reaction, physical properties of materials and/or use are to be understood as modified by the word "about". Numerical ranges expressed in the format "from x to y" are understood to include x and y. When for a specific feature multiple preferred ranges are described in the format "from x to y", it is understood that all ranges combining the different endpoints are also contemplated.

DETAILED DESCRIPTION OF THE INVENTION

The present invention provides an aqueous composition for treating a substrate, comprising a solvent mix and a bipolar antimicrobial particle. The balance of the composition is made up to 100% by weight with water.

Solvent Mix

The aqueous composition of the present invention comprises a solvent mix comprising a diol, a fatty acid ester and a glycol ether.

Diol:

The Diol used in the present invention are vicinal diols with carbon chain lengths from $C_7$ to $C_{14}$ which includes 1,2-heptanediol, 1,2-nonanediol, 1,2-decanediol, 1,2-dodecanediol, 1,2-tetradecanediol.

Preferred diol is 1,2 Octanediol due to its superior performance in combination with glycol ether, fatty acid ester and the bipolar antimicrobial particle.

The diol is present in a concentration of 2 to 25%, preferably at least 3%, more preferably at least 5%, still more preferably at least 10% but typically not more than 20%, preferably not more than 15% by weight of the solvent mix.

Glycol Ether:

Glycol ether of the present invention includes materials such as DOWANOL™ (trademark of The Dow Chemical Company) P and E series including both water soluble and water insoluble glycol ether or glycol ether ester, ethylene glycol mono n-butyl ether, ethylene glycol monomethyl ether, propylene glycol monomethyl ether, propylene glycol mono n-butyl ether (PnB), dipropylene glycol monomethyl ether, dipropylene glycol mono propyl ether (DPnP), dipropylene glycol mono n-butyl ether (DPnB), and diethylene glycol butyl ether (DB), propylene glycol mono phenyl ether, propylene glycol monomethyl ether acetate. However, P series glycol ethers are more preferred over E-series as they are more environmentally safe.

Preferred glycol ethers are selected based on Hansen solubility parameter. If the target soil is considered as body fluid or sebum or common oily/fatty stains such as cooking oil/DMO, the glycol ethers whose RED is less than 2 against these soils have been proven to show efficacy. RED i.e. relative energy differences, indicates the extent of solubility of a solute in a particular solvent. RED is a unit less number which is essentially the ratio of $R_a/R_0$. In 3 coordinate system $R_0$ is defined as the maximum interaction radius of a solute and $R_a$ is defined as the interaction radius for the respective solvent. RED is calculated using solubility parameters which consists of polar, dispersion and hydrogen bonding component of intermolecular interactions pertaining to both solvent and solute. Dipropylene glycol n-butyl ether, Dipropylene glycol dimethyl ether and dipropylene glycol methyl ether acetate are the most preferred.

The glycol ether is present in a concentration of 2 to 80%, preferably not more than 70%, more preferably not more than 60%, still more preferably not more than 50%, even more preferably not more than 40% but typically not less than 5%, preferably not less than 10%, more preferably not less than 15%, still more preferably not less than 20%, even more preferably not less than 25% by weight of the solvent mix.

Fatty Acid Ester:

Fatty acid ester of the present invention is of the formula:

R1COR2 wherein R1 represents an alkyl group having 6-15 carbon atoms and R2 is preferably a methyl or ethyl.

The preferred esters are those where R1CO is relatively long chain fatty acyl group, i.e. where R1 has 7 to 13 carbon atoms. In these compounds R2 is preferably a methyl radical.

Particularly preferred due to its performance and availability is Methyl Laurate and Olefinicmethyl Laurtae i.e. methyl dodec-9 enoate.

The fatty acid ester is present in a concentration of 2 to 80%, preferably not more than 70%, more preferably not more than 60%, still more preferably not more than 50%, even more preferably not more than 40% but typically not less than 5%, preferably not less than 10%, more preferably not less than 15%, still more preferably not less than 20%, even more preferably not less than 25% by weight of the solvent mix.

The solvent mix is present in the composition in a concentration of 1 to 60%, preferably not less than 5%, more preferably not less than 10%, still more preferably not less than 15%, even more preferably not less than 20% but typically not more than 55%, preferably not more than 50%, more preferably not more than 45%, still more preferably not more 40% or even not more than 35% by weight of the composition.

Bipolar Antimicrobial Particle

The bipolar antimicrobial particle of the present invention is an asymmetric 1:1 or 2:1:1 clay particle comprising alternating tetrahedral and octahedral sheets terminating with a tetrahedral sheet at one external surface plane and an octahedral sheet at another external surface plane and an antimicrobial group attached to the coordinating cation on one of the said external surface plane.

The antimicrobial group is selected from quaternary ammonium material comprising a single alkyl or alkenyl long chain having an average chain length greater than or equal to $C_{20}$ or a quaternary ammonium material selected from cetylpyridinium chloride (CPC), Cetyltrimethyl ammonium Bromide(CTAB), Benzylkonium (BKC), Benzethonium chloride, cetrimide, Quaternium, polyhexamethylene BH, antimicrobial alcohols, antimicrobial phenols, antimicrobial organic acids/salts, Zinc pyrithione, Ketoconazole, Octopirox or combinations thereof.

The preferred antimicrobial group is cetylpyridinium chloride (CPC).

The bipolar antimicrobial particles such as those disclosed in WO 2011/036031 is incorporated herein by reference.

The bipolar antimicrobial particle is present in the composition in a concentration of 0.2 to 5%, preferably not less than 0.25%, more preferably not less than 1%, still more preferably not less than 1.5%, even more preferably not less than 2% but typically not more than 4.5%, preferably not more than 4%, more preferably not more than 3.5%, still more preferably not more 3% or even not more than 2.5% by weight of the composition.

Water

The composition of the present invention is an aqueous composition comprising water.

The composition is made up to 100 percent by adding water. The composition preferably comprises 39.9-98.9% by weight of water.

Optional Ingredients

The cleaning composition may comprise additional ingredients such as polymeric emulsifiers, non-ionic surfactants, SRPs (soil release polymers), perfumes, preservatives, brighteners, salt to control viscosity, pH adjusters or buffers, enzymes etc. In the present invention, Pemulen and Novemer EC2 as supplied by Lubrizol can be used as polymeric emulsifiers. These are the high molecular weight polyacrylates which have both hydrophobic and hydrophilic moiety present. Non-ionic surfactants that are suitable are linear or branched fatty alcohol or a condensation product of a linear or branched fatty alcohol and alkylene oxide (e. g. ethylene oxide and/or propylene oxide), preferably ethylene oxide (also known as ethoxylated fatty alcohol or alcohol ethoxylate). Linear or branched fatty alcohol chain comprises from 5 to 8 carbon atoms. When the fatty alcohol is alkoxylated, the number of alkylene oxide groups is not more than 5, preferably between 1 and 4. Ethylene oxide (EO) groups are the most preferred. In the present invention, Neodol supplied by Shell can be used as a non-ionic surfactant. Example of an SRP (soil release polymers) that can used in this invention is Texcare SRN UL. Perfumes, preservatives, brighteners, salt to control viscosity, pH adjusters or buffers, enzymes etc are the other optional ingredients that may be present.

Process for Treating a Fabric

In a second aspect, the invention relates to a method for treating a substrate comprising the steps in sequence of applying the composition according to the invention onto a substrate and allowing the substrate to dry.

The composition may be applied by any known method such as by using wipes, spray, including spray guns, atomizers, or other direct application.

Optionally, the substrate may be rinsed after the application of the composition and before drying.

Use of the Composition

In a third aspect, the invention relates to the use of the composition according to the invention for cleaning and antimicrobial benefits.

Product Format

The formulation can be in two formats: spray and wipe. Spray can be applied to the problem area e.g. underarm, collar/cuff or can be applied to entire fabric. This would provide antimicrobial benefit and deliver perfume. For the wipe format, formulation needs to be loaded on non-woven fabric made of polypropylene. This can be applied and rubbed on directly to the soil/stained areas. This application would provide cleaning, anti-microbial benefit as well as deliver perfume.

EXAMPLES

Materials

| | Chemical/Material | Grade | Manufacturer/ Supplier |
|---|---|---|---|
| Glycol ether | Dipropylene Glycol n-Butyl Ether | Lab grade | Aldrich |
| Fatty acid ester | Methyl Laurate | Commercial grade | KLK |
| Diol | 1,2-Octane diol | Commercial grade | Avra synthesis pvt ltd |
| Nonionic surfactant | Neodol 25-7 (C12-C15, with an average of approximately 7 moles of ethylene oxide per mole of alcohol) | Commercial grade | Shell |
| Polymeric emulsifier | Pemulen TR2 (High molecular weight polyacrylate) | Commercial grade | Lubrizol corporation |
| NaOH | Sodium hydroxide | Lab grade | Aldrich |
| Perfume | Lilac | commercial | Givaudan India Pvt ltd |

Making the Bipolar Antimicrobial Particle:

| | Chemical/Material | Grade | Manufacturer/ Supplier |
|---|---|---|---|
| CPC | Hexadecylpyridinium chloride, Monohydrate | Lab grade | Aldrich |
| Clay | Aluminosilicates (1:1) | Super Shine 90 (SS90) | English Indian Clays Ltd |

The fume hood, electronic balance and magnetic stirrer were wiped with ethanol (99.9%), and the beaker, measuring cylinder, magnetic fish, and centrifuge tubes were rinsed with autoclaved MQ water and then with ethanol.

250 grams of clay was taken in the beaker and 2.5 litres of autoclaved MQ water was added to it. The pH of the suspension was adjusted to ~9 using 0.1N NaOH. The suspension was stirred for 15 minutes using the magnetic stirrer.

To this suspension 125 grams of cetylpyridinium chloride was added slowly while being stirred. The beaker was covered with aluminium foil and the suspension was continuously stirred for 4 hours. After 4 hours, the stirrer was switched off and the suspension was placed in the fume hood for two hours for equilibration. The suspension was divided equally into four centrifuge tubes and centrifuged for 15 minutes at 4000 rpm. The supernatant was removed and autoclaved MQ water was added to the tubes for rinsing. The water was separated by centrifuging and the process was repeated 3 more times.

Finally the clay was rinsed with ethanol and again separated by centrifuging. The oven walls and racks were wiped with ethanol and the rinsed clay was kept for drying at 40 to 50 degree C. The dried clay was ground in mortar and pestle (rinsed with ethanol) and stored in a clean and sterilized container.

Preparation of the Composition and the Order of Addition:

All The solvents i.e. Glycol ether, fatty acid ester and diol were mixed in a vortex mixer for 5 minutes in order to prepare a homogeneous mixture. The polymeric emulsifier and the perfume were then added into the solvent mix and stirred for 5 minutes. The suspension of bipolar antimicrobial particle in water was prepared in presence of the non-ionic surfactant. Then the mix of solvent and emulsifier was added slowly into the aqueous part under high mixing condition which was maintained by stirring (Heidolph) at 13000-18000 rpm. The mixing was continued for 15 minutes to achieve a homogeneous emulsion which was white in colour.

Procedure for Soiling the Fabric:

The cleaning benefit was evaluated on artificial test monitors such as WFKs i.e. WFK 10D (cotton), WFK 20D (polycotton), WFK 30D (polyester) supplied by WFK, Germany. WFK swatches are composite soil made up of particulate soil and oily soil.

Procedure for Treating Fabric:

0.5 ml of the test solution/formulation was added to the test monitor and was kept in contact for 5 minutes and then was rinsed in tergotometer at L/C (liquor/cloth) of ~80:1 at 90 rpm for 2 minutes in deionized water. Only one rinse was provided. The cleaning evaluation was later done after drying the fabrics.

Evaluation of Fabric:

The cleaning evaluation was done on WFK fabrics by monitoring reflectance of fabrics at 460 nm. The difference in initial reflectance and the final reflectance ($\Delta R$) was measured using a spectrophotometer (Gretag Macbeth Colour-Eye 7000A). A higher difference in $\Delta R$ means better cleaning achieved with the test solution.

Cleaning performance is considered to be good if Delta-R on cotton is above 15.

Procedure and Test for Antimicrobial Benefit:

The hygiene efficacy of the formulation was evaluated with an in-vitro bacterial plate test.

Protocol: European Suspension Test (EST) or BS EN 1276 B

Test bacteria: *Staphylococcus aureus* ATCC 6538 (Gram-positive)

*Escherichia coli* ATCC 10536 (Gram-negative)

The test bacteria was grown overnight at 37° C. on TSA plate. The grown culture colonies were re-suspended in 0.9% saline solution. The culture cell density was adjusted to get the final count of $1\times10^8$ CFU/ml, based on a 620 nm optical density (OD) calibration chart (0.2 OD at 620 nm and 0.8 OD at 620 nm for above bacteria respectively). 8 ml of the test solution was taken in a sterile sample container and 1 ml of test culture with 1 ml of 0.3% (w/v) BSA or bovine serum albumin (protein) was added. After the specified contact time, 1 ml of the above mixture was immediately neutralized in 9 ml Dey Engley neutralizing broth and plated on Tryptic Soy Agar in duplicates. In case of the control, 1 ml of the test culture was mixed with 1 ml of 0.3% BSA and added to 8 ml hard water, and was serially diluted and plated on TSA. After solidification, the plates were incubated at 37° C. for 48 hours, and the residual colonies were counted. In the examples, below the log values of the residual colony forming units (CFUs) is given and compared. In comparing the log value 1 point more reduction means a 10-fold higher kill. So, for instance, when under comparative conditions, the residual log value is 4 or 10000 CFU, and the inventive composition is 2, i.e., 100, then this means that the end culture that is treated with the inventive composition has only 1% of the residual bacteria as the comparative composition.

Antimicrobial benefit is considered to be good if the log reduction is more than 4.

The composition according to the invention should preferably be superior in both cleaning and antimicrobial benefits.

Example 1: Effect of Each Component of the Composition on Cleaning Performance In this example, the composition according to the invention (Glycol ether+Fatty acid ester+Diol+Bipolar antimicrobial particle) is compared to comparative compositions outside the scope of the invention.

TABLE 1

| wt % | Formulation * Delta R 460 | | |
|---|---|---|---|
| | WFK 10D (cotton) | WFK 20D (polycotton) | WFK 30D (polyester) |
| Glycol ether (5%) + Fatty acid ester (5%) + Diol (2%) + Bipolar antimicrobial particle (0.5%) | 15.46 | 19.60 | 11.82 |
| Glycol ether (10%) + Diol (2%) + Bipolar antimicrobial particle (0.5%) | 7.35 | 8.95 | 11.60 |
| Fatty acid ester (10%) + Diol (2%) + Bipolar antimicrobial particle (0.5%) | 13.69 | 19.19 | 19.87 |
| Fatty acid ester (6%) + Glycol ether (6%) + Bipolar antimicrobial particle (0.5%) | 10.17 | 16.21 | 13.57 |
| Diol (12%) + Bipolar antimicrobial particle (0.5%) | 9.54 | 10.59 | 11.24 |
| Fatty acid ester (12%) + Bipolar antimicrobial particle (0.5%) | 10.14 | 6.31 | 13.63 |
| Glycol ether (12%) + Bipolar antimicrobial particle (0.5%) | 6.97 | 13.74 | 16.89 |

* all formulations in this table additionally contain 1.85 wt % optional ingredients (NaOH, PemulenTR2, Nonionic surfactant, Perfume), and 85.65 wt % water The above table shows that the composition according to the invention provides superior cleaning when compared to any of the other combinations except the combination of fatty acid ester, diol and bipolar antimicrobial particle. However, it can be noted below in Example 2 that the desired antimicrobial benefit is not achieved with the combination of fatty acid ester, diol and bipolar antimicrobial particle alone.

Example 2: Effect of Each Component of the Composition on Antimicrobial Benefit In this example, the composition according to the invention (Glycol ether+Fatty acid ester +Diol+Bipolar antimicrobial particle) is compared to comparative compositions with at least one of the components of the composition missing.

TABLE 2

| Formulation (Wt %) | Optional ingredients (Wt %) * | Water (Wt %) | *S. aureus* Control or Initial Count, Log CFU/ml | *S. aureus* Log reduction | *E. coli* Control or Initial Count, Log CFU/ml | *E coli* Log reduction |
|---|---|---|---|---|---|---|
| 12% Diol + 1% Bipolar anti-microbial particle | 1.845 | 85.155 | 7.51 | 6.51 | 7.96 | 6.96 |
| 12% Glycol ether + 1% Bipolar anti-microbial particle | 1.845 | 85.155 | | 3.40 | | 5.31 |
| 12% Fatty acid ester + 1% Bipolar anti-microbial particle | 1.845 | 85.155 | | 0.81 | | 1.26 |
| 2% Diol + 10% Glycol ether + 1% Bipolar anti-microbial particle | 1.845 | 95.155 | | 4.59 | | 4.24 |
| 2% Diol + 10% Fatty acid ester + 1% Bipolar anti-microbial particle | 1.845 | 95.155 | | 1.78 | | 6.96 |
| 6% Glycol ether + 6% Fatty acid ester + 1% | 1.845 | 85.155 | | 0.81 | | 1.26 |

TABLE 2-continued

| Formulation (Wt %) | Optional ingredients (Wt %) * | Water (Wt %) | *S. aureus* Control or Initial Count, Log CFU/ml | *S. aureus* Log reduction | *E. coli* Control or Initial Count, Log CFU/ml | *E coli* Log reduction |
|---|---|---|---|---|---|---|
| Bipolar anti-microbial particle | | | | | | |
| 2% Diol + 5% Glycol ether + 5% Fatty acid ester | 1.845 | 86.155 | | 1.27 | | 6.96 |
| 1% Bipolar anti-microbial particle | 1.845 | 97.155 | | 0.44 | | 0.30 |
| 2% Diol + 5% Glycol ether + 5% Fatty acid ester + 1% Bipolar anti-microbial particle | 1.845 | 85.155 | | 4.85 | | 6.96 |

* optional ingredients are NaOH, PemulenTR2, Nonionic surfactant, Perfume

The combination of diol and the bipolar antimicrobial particle provides a significant log reduction of both Gram-positive and Gram-negative bacteria but as seen in the example 1, cleaning performance is not delivered only through diol and the bipolar antimicrobial particle. The addition of fatty acid ester to this combination gives superior cleaning performance, but the antimicrobial efficacy is hampered, especially for Gram-positive bacteria. The antimicrobial efficacy is best upon addition of glycol ether to the combination of diol, fatty acid ester and the bipolar antimicrobial particle. The above table also shows that the combination of diol, glycol ether and fatty acid ester does not give antimicrobial efficacy for Gram-positive.

Example 3: Level of Bipolar Antimicrobial Particle in the Composition and its Effect on Antimicrobial Benefit In this example, the composition according to the invention (Glycol ether+Fatty acid ester+Diol+Bipolar antimicrobial particle) is compared to comparative compositions with lower levels of bipolar antimicrobial particle.

TABLE 3

| | % of water in formulation | *S. aureus* Control or Initial Count, CFU/ml | Residual counts, CFU/ml | *S. aureus* Control or Initial Count, CFU/ml | Residual counts, Log CFU/ml | Log reduction |
|---|---|---|---|---|---|---|
| 2% OD + 5% BPP + 5% ML (w/o bipolar antimicrobial particle) | 88.00 | 1.10E+07 | 4.07E+05 | 7.04 | 5.61 | 1.43 |
| 2% OD + 5% BPP + 5% ML+ 1% bipolar antimicrobial particle | 87.00 | | 1.15E+02 | | 2.06 | 4.98 |
| 2% OD + 5% BPP + 5% ML+ 0.25% bipolar antimicrobial particle | 87.75 | | 3.31E+02 | | 2.52 | 4.52 |
| 2% OD + 5% BPP + 5% ML + 0.1% bipolar antimicrobial particle | 87.90 | | 3.47E+04 | | 4.54 | 2.50 |

The above table shows that superior antimicrobial benefit is achieved with a bipolar antimicrobial particle concentration as claimed in the present invention but the best results are seen when the bipolar antimicrobial particle is at a level of 0.25% or more. Increasing level of the bipolar antimicrobial particle i.e, above 1% will deliver similar or better antimicrobial benefit, however it will leave behind unwanted residues on garment especially if the garments are not further rinsed off.

The invention claimed is:

1. An aqueous composition for treating a substrate, comprising:

a) 1 to 60% by weight of a solvent mix comprising:

i. 2 to 25% by weight of the solvent mix of a diol which is a vicinal diol with carbon chain length from $C_7$ to $C_{14}$;

ii. 2 to 80% by weight of the solvent mix of a fatty acid ester of the formula R1COR2 wherein R1 represents an alkyl group having 6 to 15 carbon atoms and R2 is methyl or ethyl;

iii. 2 to 80% by weight of the solvent mix of a glycol ether;

b) 0.2 to 5% by weight of a bipolar antimicrobial particle which is an asymmetric 1:1 or 2:1:1 clay particle comprising alternating tetrahedral and octahedral sheets terminating with a tetrahedral sheet at one external surface plane and an octahedral sheet at another external surface plane and an antimicrobial group attached to the coordinating cation on one of the said external surface plane, wherein the antimicrobial group is selected from quaternary ammonium material comprising a single alkyl or alkenyl long chain having an average chain length greater than or equal to $C_{20}$ or a quaternary ammonium material selected from cetylpyridinium chloride (CPC), Cetyltrimethyl ammonium Bromide (CTAB), Benzylkonium (BKC), Benzethonium chloride, cetrimide, Quaternium, polyhexamethylene BH, antimicrobial alcohols, antimicrobial phenols, antimicrobial organic acids/salts, Zinc pyrithione, Ketoconazole, Octopirox or combinations thereof; and c) water.

2. A composition according to claim 1 wherein the composition comprises 39.9-98.9% by weight of water.

3. A composition according to claim 1 wherein the diol is 1,2 Octanediol.

4. A composition according to claim 1 wherein the composition comprises 0.25 to 5% by weight of the bipolar antimicrobial particle.

5. A composition according to claim 1 wherein the fatty acid ester is methyl laurate.

6. A method for treating a substrate comprising the steps, in sequence, of:

a) applying the composition according to claim 1 onto the substrate; and, b) allowing the substrate to dry.

7. Use of the composition according to claim 1 for cleaning and antimicrobial benefits.

* * * * *